US010458322B2

(12) United States Patent
Kubo et al.

(10) Patent No.: US 10,458,322 B2
(45) Date of Patent: Oct. 29, 2019

(54) SURGE DETERMINATION DEVICE, SURGE DETERMINATION METHOD, AND PROGRAM

(71) Applicant: MITSUBISHI HEAVY INDUSTRIES, LTD., Tokyo (JP)

(72) Inventors: Hiroyoshi Kubo, Tokyo (JP); Yukio Yamashita, Tokyo (JP); Mitsufumi Goto, Tokyo (JP); Musashi Sakamoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 128 days.

(21) Appl. No.: 15/506,051

(22) PCT Filed: Feb. 10, 2015

(86) PCT No.: PCT/JP2015/053653
§ 371 (c)(1),
(2) Date: Feb. 23, 2017

(87) PCT Pub. No.: WO2016/059810
PCT Pub. Date: Apr. 21, 2016

(65) Prior Publication Data

US 2017/0298814 A1 Oct. 19, 2017

(30) Foreign Application Priority Data

Oct. 14, 2014 (JP) ..... 2014-209814

(51) Int. Cl.
*F02B 39/16* (2006.01)
*F02D 45/00* (2006.01)
(Continued)

(52) U.S. Cl.
CPC ..... *F02B 39/16* (2013.01); *F02D 41/22* (2013.01); *F02D 41/26* (2013.01); *F02D 45/00* (2013.01);
(Continued)

(58) Field of Classification Search
CPC ..... F02B 39/16; F02D 41/22; F02D 41/26; F02D 45/00; F02D 2200/101; F02D 2200/04
(Continued)

(56) References Cited

U.S. PATENT DOCUMENTS 4,265,589 A 5/1981 Watson et al.
2010/0198555 A1* 8/2010 Takahama ..... F01D 19/00 702/179

FOREIGN PATENT DOCUMENTS

CN 1914413 A 2/2007
CN 101341322 A 1/2009
(Continued)

OTHER PUBLICATIONS

JP 2008101552 A—English Translation.*
(Continued)

*Primary Examiner* — Joseph J Dallo
*Assistant Examiner* — Scott A Reinbold
(74) *Attorney, Agent, or Firm* — Birch, Stewart, Kolasch & Birch, LLP

(57) ABSTRACT

This surge determination device is provided with a surge determination unit for determining the presence or absence of a surge of a compressor that outputs compressed air to an engine on the basis of a rotation speed of the engine and an air flow rate.

7 Claims, 3 Drawing Sheets

(51) Int. Cl.
*F02D 41/22* (2006.01)
*F02D 41/26* (2006.01)

(52) U.S. Cl.
CPC .... *F02D 2200/04* (2013.01); *F02D 2200/101* (2013.01)

(58) Field of Classification Search
USPC ..... 701/102
See application file for complete search history.

(56) References Cited

FOREIGN PATENT DOCUMENTS

| | | | | | |
|---|---|---|---|---|---|
| JP | 56-2496 | A | | 1/1981 | |
| JP | 59-79097 | A | | 5/1984 | |
| JP | 62-113889 | A | | 5/1987 | |
| JP | 5-53956 | B2 | | 8/1993 | |
| JP | 2007-92682 | A | | 4/2007 | |
| JP | 2008-101552 | A | | 5/2008 | |
| JP | 2008101552 | A | * | 5/2008 | ..... F02B 37/10 |
| JP | 2008101552 | A | * | 5/2008 | ..... F02B 37/10 |
| JP | 2010-1822 | A | | 1/2010 | |
| JP | 4433802 | B2 | | 1/2010 | |
| JP | 2013-96372 | A | | 5/2013 | |
| JP | 2015-108329 | A | | 6/2015 | |
| WO | WO 2005/064136 | A1 | | 7/2005 | |
| WO | WO 2007/122499 | A1 | | 11/2007 | |
| WO | WO-2007122499 | A1 | * | 11/2007 | ..... F02B 37/12 |

OTHER PUBLICATIONS

JP 2008101552 A—English Translation (Year: 2008).*
International Search Report dated May 19, 2015 in PCT Application No. PCT/JP2015/053653 with an English Translation.
Written Opinion dated May 19, 2015 in PCT Application No. PCT/JP2015/053653 with an English Translation.

* cited by examiner

SURGE DETERMINATION DEVICE, SURGE DETERMINATION METHOD, AND PROGRAM

TECHNICAL FIELD

The present invention relates to a surge determination device, a surge determination method, and a program.

Priority is claimed on Japanese Patent Application No. 2014-209814, filed Oct. 14, 2014, the content of which is incorporated herein by reference.

BACKGROUND ART

In a compressor of a turbocharger that supplies compressed air to an engine, a surge may occur in a case where a flow rate is low relative to a pressure ratio between an inlet and an outlet. The surge of the compressor is an abnormal operation state of the compressor which occurs in a case where a flow rate is low relative to a pressure ratio. When the surge occurs, vibration of the flow rate or the pressure is caused due to flow separation or reattachment.

If the surge continues, the compressor is likely to be damaged. Accordingly, measures are taken to avoid the surge. For example, measures are taken such as selecting a compressor having a margin so that an operating point does not enter a surge area, and avoiding the surge by means of a logic using a map (parameter) indicating characteristics of the compressor.

However, even in a case where measures are taken to avoid the surge, characteristics of the compressor are likely to change due to aging or the like and a surge is likely to occur. Therefore, a technology for determining whether or not there is a surge has been proposed.

For example, PTL 1 discloses that a temperature detection device that detects a temperature of a gas passing through an intermediate cooler arranged between a plurality of compression stages and flowing into a next-stage compressor is provided, and a turbo compressor performs a determination as to a surge on the basis of the temperature detected by the temperature detection device.

PATENT LITERATURE

[PTL 1] Japanese Patent No. 4433802

SUMMARY OF INVENTION

Technical Problem

In a technology for detecting a temperature of gas or the like and determining whether or not there is a surge, it is necessary to install a temperature sensor, which leads to an increase in cost of a device.

The present invention provides a surge determination device, a surge determination method, and a program capable of determining whether or not there is a surge without the need to provide a temperature sensor.

Solution to Problem

According to a first aspect of the present invention, a surge determination device includes a surge determination unit that determines whether or not there is a surge of a compressor that outputs compressed air to an engine on the basis of an engine rotation speed and an air flow rate.

The surge determination device may include a determination condition setting unit that sets a determination condition for a determination as to whether or not there is a surge on the basis of the engine rotation speed and the air flow rate when it is determined that no surge occurs in the compressor.

The determination condition setting unit may set the determination condition based on a Mahalanobis distance.

The surge determination unit may determine that a surge occurs in a case where a state satisfying a certain condition continues for a predetermined time or more.

The surge determination unit may determine that a surge occurs in a case where a state satisfying a certain condition appears a predetermined times or more for a predetermined time.

According to a second aspect of the present invention, a surge determination method is a surge determination method for a surge determination device, and includes a surge determination step of determining whether or not there is a surge of a compressor that outputs compressed air to an engine on the basis of an engine rotation speed and an air flow rate.

According to a third aspect of the present invention, a program is a program for causing a computer to execute a surge determination step of determining whether or not there is a surge of a compressor that outputs compressed air to an engine on the basis of an engine rotation speed and an air flow rate.

Advantageous Effects of Invention

According to the surge determination device, the surge determination method, and the program, it is possible to determine whether or not there is a surge without the need to provide a temperature sensor.

DESCRIPTION OF EMBODIMENTS

Hereinafter, embodiments of the present invention will be described, but the following embodiments do not limit the invention according to the claims. Further, all combinations of characteristics described in the embodiments are not necessarily essential to solving means of the invention.

Figure 1:
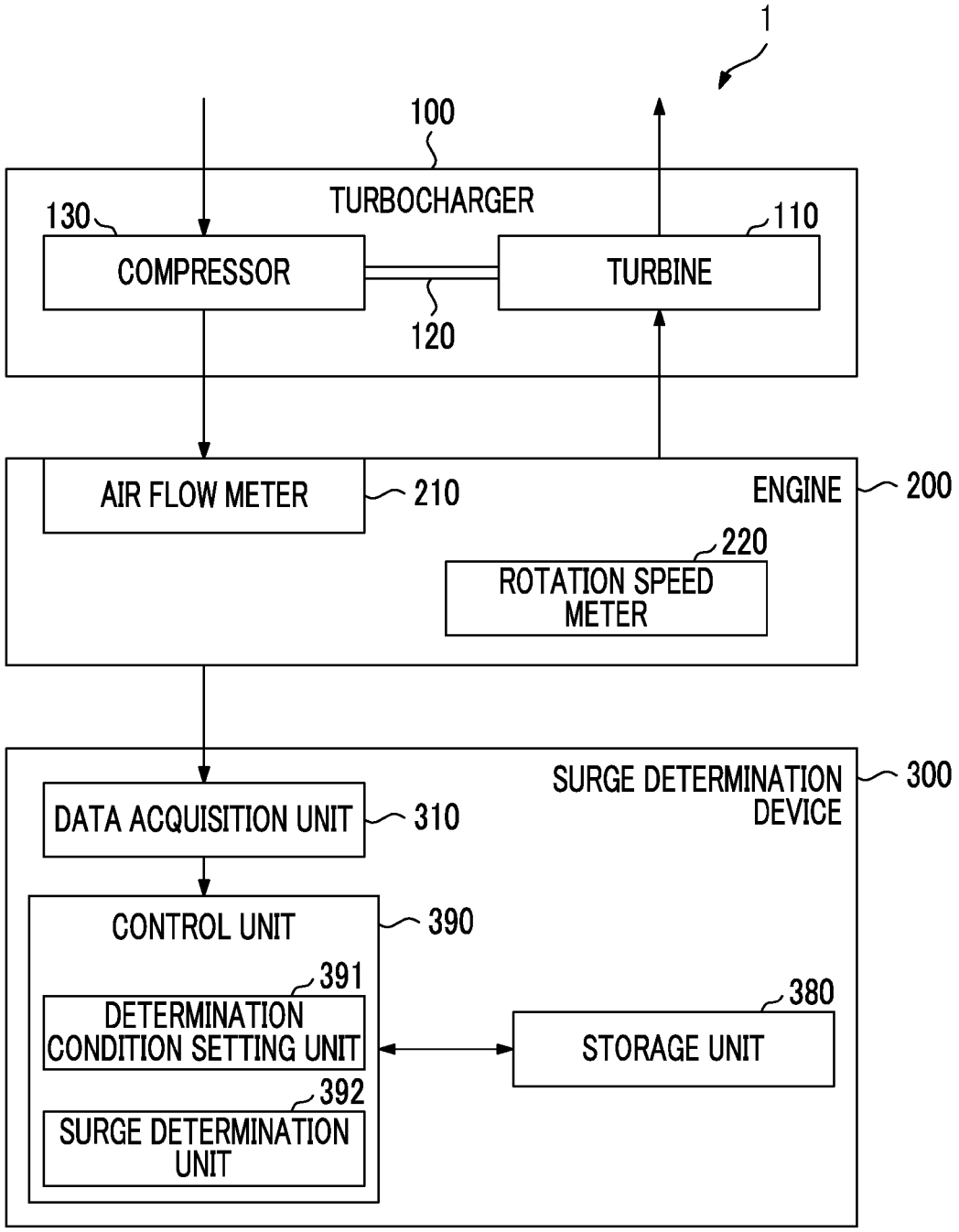
FIG. 1 is a schematic block diagram illustrating a functional configuration of an engine system in an embodiment of the present invention.

FIG. 1 is a schematic block diagram illustrating a functional configuration of an engine system in an embodiment of the present invention. In FIG. 1, the engine system 1 includes a turbocharger 100, an engine 200, and a surge determination device 300. The turbocharger 100 includes a turbine 110, a shaft 120, and a compressor 130. The engine 200 includes an air flow meter 210 and a rotation speed meter 220. The surge determination device 300 includes a data acquisition unit 310, a storage unit 380, and a control unit 390. The control unit 390 includes a determination condition setting unit 391 and a surge determination unit 392.

The turbocharger 100 is a type of supercharger, and compresses air and outputs the compressed air to the engine 200. The engine 200 burns the fuel using the air compressed by the turbocharger 100. Thus, a torque or an output of the engine 200 can be increased.

The turbine 110 receives a discharge (expansion force) of an exhaust gas from the engine 200 to generate a rotational force.

The shaft 120 transmits the rotational force generated by the turbine 110 to the compressor 130.

The compressor 130 is driven by the rotational force from the turbine 110 transmitted by the shaft 120, compresses the air taken in from the surroundings, and outputs the compressed air to the engine 200.

In a case where a flow rate is low relative to a pressure ratio between an inlet and an outlet of the compressor 130, a surge may occur. If the surge occurs, vibration of the flow rate or the pressure occurs due to flow separation and reattachment.

Figure 2:
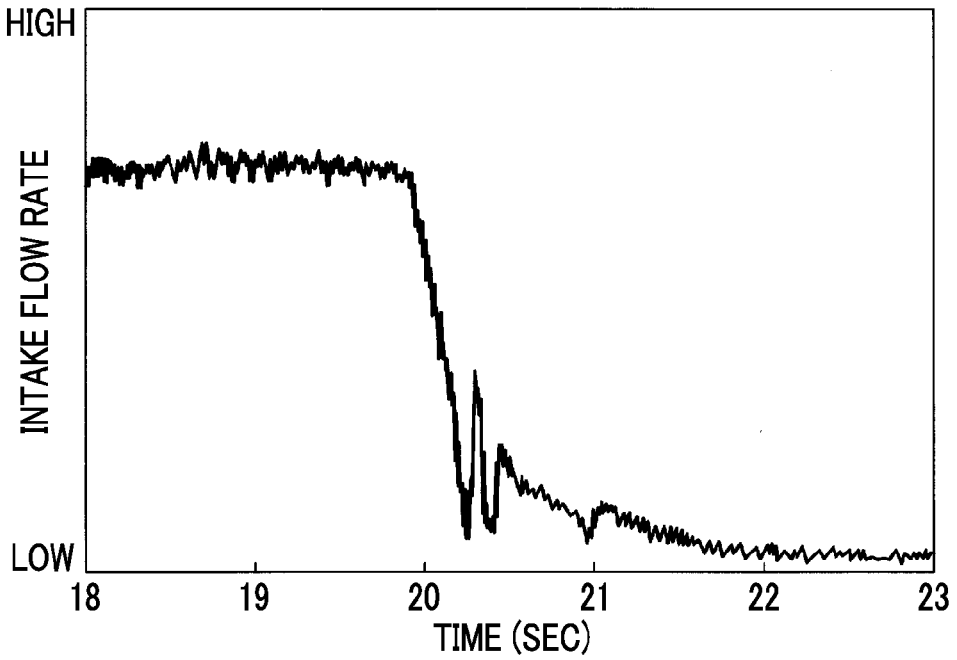
FIG. 2 is a graph illustrating an example of fluctuation in flow rate in a case where a surge occurs in a compressor in the embodiment.

FIG. 2 is a graph illustrating an example of fluctuation in flow rate in a case where a surge occurs in the compressor 130. In FIG. 2, a horizontal axis indicates time and a vertical axis indicates an intake flow rate of the engine 200 (a flow rate of compressed air output by the compressor 130).

In FIG. 2, the intake flow rate decreases and vibration of the intake flow rate due to the surge occurs.

The engine 200 mixes, for example, a fuel such as gasoline with the compressed air from the turbocharger 100 and burns the mixture to generate a rotational force. The engine 200 can be various engines such as an engine for a vehicle or an engine for a ship.

The air flow meter 210 is provided at an intake port of the engine 200 and measures a flow rate of intake air of the engine 200 per unit time. The air flow meter 210 may be configured as a part of the engine 200.

Alternatively, the air flow meter 210 may be a device separate from the engine 200.

In a vehicle such as a gasoline vehicle or a diesel vehicle, an air flow meter is often mounted as a standard. By using the air flow meter mounted as a standard in this manner is used as the air flow meter 210, it is not necessary to provide the air flow meter 210 dedicated to the engine system 1, and it is possible to reduce equipment cost of the engine system 1.

The rotation speed meter 220 measures the rotation speed (that is, the number of rotations) of the engine 200 per unit time.

In a vehicle, an engine rotation meter (tachometer) is often mounted as a standard. By using the engine rotation meter mounted thus as a standard as the rotation speed meter 220, it is not necessary to provide the rotation speed meter 220 dedicated to the engine system 1, and it is possible to reduce an equipment cost of the engine system 1.

Even in a case where the rotation speed meter 220 is newly installed, it is possible to obtain the engine rotation speed from a crank pulse, and realize the rotation speed meter 220 with a simple structure.

The surge determination device 300 determines whether or not there is a surge in the compressor 130 on the basis of the rotation speed of the engine 200 and the air flow rate. The surge determination device 300 may be realized using a computer such as a microcomputer, for example. Further, the surge determination device 300 may be realized as a part of another device, such as a function of an engine control unit (ECU), or may be realized as a device dedicated to a surge determination.

The data acquisition unit 310 acquires information indicating a state of the engine 200. In particular, the data acquisition unit 310 acquires the intake flow rate of the engine 200 measured by the air flow meter 210 and the rotation speed of the engine 200 measured by the rotation speed meter 220.

The storage unit 380 is realized using a storage device included in the surge determination device 300, and stores various types of information. In particular, the storage unit 380 stores time-series data of the information acquired by the data acquisition unit 310.

The control unit 390 controls each unit of the surge determination device 300 to perform various processes. The control unit 390 is realized, for example, by a central processing unit (CPU) included in the surge determination device 300 reading a program from the storage unit 380 and executing the program.

The determination condition setting unit 391 sets a determination criterion for determining whether or not there is a surge of the compressor 130. In particular, the determination condition setting unit 391 sets the determination criterion for determining whether or not there is a surge of the compressor 130 on the basis of the engine rotation speed measured by the rotation speed meter 220 and the air flow rate measured by the air flow meter 210.

Here, the determination condition setting unit 391 may set a determination condition for determining whether or not there is a surge of the compressor 130 on the basis of the engine rotation speed and the air flow rate when it is determined that no surge has occurred in the compressor 130. For example, the storage unit 380 stores time-series data of the engine rotation speed measured by the rotation speed meter 220 and time-series data of the air flow rate measured by the air flow meter 210. If a checker decides, a posteriori, that no surge has occurred in the compressor 130 at the time of periodic inspection, the determination condition setting unit 391 reads the data from the storage unit 380 and sets the determination condition.

The determination condition setting unit 391 sets the determination condition based on a Mahalanobis distance, for example, using the engine rotation speed and the air flow rate when it is determined that no surge has occurred in the compressor 130, as a unit space. The unit space described herein is a group of data indicating values in a normal operation.

The Mahalanobis distance in the case of an N variable (N is a positive integer) is shown as shown in Equation (1).

[Equation 1]

$$MD^2 = \begin{pmatrix} x-x' & y-y' & z-z' & \dots \end{pmatrix} \begin{pmatrix} S_x^2 & S_{xy} & S_{xz} & \dots \\ S_{xy} & S_y^2 & S_{yz} & \dots \\ S_{xz} & S_{yz} & S_z^2 & \dots \\ \dots & \dots & \dots & \dots \end{pmatrix}^{-1} \begin{pmatrix} x-x' \\ y-y' \\ z-z' \\ \dots \end{pmatrix} \quad (1)$$

Here, MD indicates the Mahalanobis distance. Further, x', y', z', . . . indicate average values of respective groups, and x, y, z, . . . indicate variables belonging to the respective groups. Therefore, x-x', y-y', and z-z' indicate displacements from the average values.

Further, an intermediate matrix of a right side indicates an inverse matrix of a variance covariance matrix. In the intermediate matrix of the right side, each of elements sx2, sy2, sz2, . . . of a diagonal line from the upper left to the lower right indicates a variance, and each of other elements sxy, sxz, syz, . . . indicates a covariance.

From Equation (1), the Mahalanobis distance in the case of a bivariate is shown as in Equation (2).

[Equation 2]

$$MD^2 = \begin{pmatrix} x - x' & y - y' \end{pmatrix} \begin{pmatrix} S_x^2 & S_{xy} \\ S_{xy} & S_y^2 \end{pmatrix}^{-1} \begin{pmatrix} x - x' \\ y - y' \end{pmatrix} \quad (2)$$

Here, MD indicates the Mahalanobis distance. Further, x' and y' indicate average values of the respective groups, and x and y indicate variables belonging to the respective groups. For example, x is the current value of the engine rotation speed and y is the current value of the air flow rate. Therefore, x-x' and y-y' indicate displacements from the average values.

Further, an intermediate matrix of a right side indicates an inverse matrix of a variance covariance matrix. In the intermediate matrix of the right side, each of elements sx2 and sy2 of a diagonal line from the upper left to the lower right indicates a variance, and another elements sxy indicates a covariance.

The determination condition setting unit 391 obtains the average value of the engine rotation speed from the time-series data of the engine rotation speed stored in the storage unit 380 and applies the average value to x'. Further, the determination condition setting unit 391 obtains an average value of the air flow rate from the time-series data of the air flow rate stored in the storage unit 380 and applies the average value to y'. Further, the determination condition setting unit 391 obtains a variance of the engine rotation speed, a variance of the air flow rate, and a covariance between the engine rotation speed and the air flow rate and applies the respective variances to sx2, sy2, and sxy. A combination of an equation obtained by the application and a preset threshold value corresponds to an example of the determination condition set by the determination condition setting unit 391.

The determination condition setting unit 391 performs the application using test data, for example, at the time of initial shipment of a vehicle having the engine system 1 mounted thereon to set the determination condition. At every periodic inspection of the vehicle, if it is determined that no surge has occurred in a period from a previous periodic inspection to a current periodic inspection, the determination condition setting unit 391 performs the above application using the data stored in the storage unit 380 to update the determination condition. So to speak, the determination condition setting unit 391 sets the determination condition offline (in advance before it is determined whether or not there is a surge). For example, the checker confirms a state of the turbocharger 100 or a state of the engine 200 to perform the determination as to whether or not there is a surge.

The determination condition setting unit 391 can update the determination condition to obtain the determination condition corresponding to a secular change of the turbocharger 100. The surge determination unit 392 determines whether or not there is a surge using the determination condition. Thus, improvement of the determination accuracy is expected.

The determination condition setting unit 391 may set the determination condition using other variables in addition to the engine rotation speed and the air flow rate. For example, the determination condition setting unit 391 may set the determination condition based on one or both of a temperature and a position of a vehicle in addition to the engine rotation speed and the air flow rate. A difference in temperature can affect a state of the turbocharger 100 or the engine 200. Further, a temperature or an altitude is different according to the position of the vehicle, which can affect the state of the turbocharger 100 or the engine 200.

The determination condition setting unit 391 sets the determination condition based on the Mahalanobis distance, thereby easily incorporating various variables into the determination condition.

However, the determination condition set by the determination condition setting unit 391 is not limited to the determination condition based on the Mahalanobis distance. For example, the determination condition setting unit 391 may set a determination condition based on multiple regression analysis.

The surge determination unit 392 determines whether or not there is a surge of the compressor 130 using the determination condition set by the determination condition setting unit 391. Accordingly, the surge determination unit 392 determines whether or not there is a surge of the compressor 130 on the basis of the engine rotation speed and the air flow rate.

Specifically, the surge determination unit 392 applies a current value of the engine rotation speed (a latest measurement value obtained by the rotation speed meter 220) and a current value of the air flow rate (a latest measurement value obtained by the air flow meter 210) to x and y of the equation obtained by the determination condition setting unit 391 performing the application to Equation 2 to obtain the Mahalanobis distance. The surge determination unit 392 reads the threshold value prestored in the storage unit 380, and determines whether or not the obtained Mahalanobis distance is larger than the threshold value.

Figure 3:
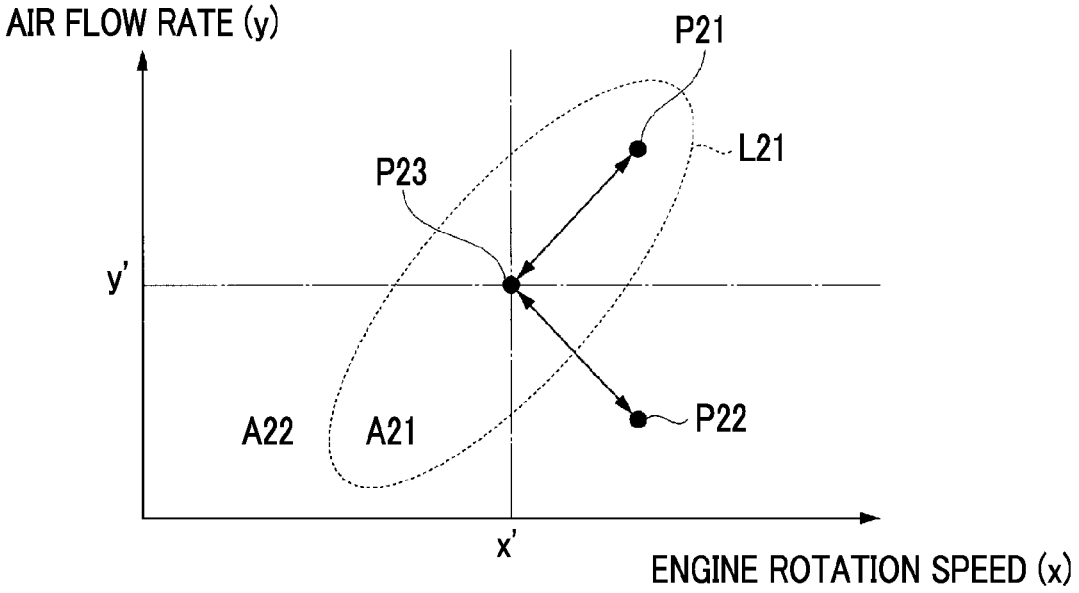
FIG. 3 is a graph illustrating an example of a relationship between a current value of each of an engine rotation speed and an air flow rate and a threshold value in the embodiment.

FIG. 3 is a graph illustrating an example of a relationship between the current value of each of the engine rotation speed and the air flow rate and the threshold value. In FIG. 3, a horizontal axis indicates the engine rotation speed and a vertical axis indicates the air flow rate.

Further, points P21 and P22 indicate examples of the current value of the engine rotation speed and the current value of the air flow rate, respectively. A point P23 indicates an average value x' of the engine rotation speed and an average value y' of the air flow rate in the unit space. A line L21 indicates an example of the threshold value of the Mahalanobis distance.

The Mahalanobis distance calculated by the surge determination unit 392 is a type of distance between a point P23 indicating the average value x' of the engine rotation speed and the average value y' of the air flow rate in the unit space and a point (for example, a point P21 or a point P22) indicating the current value of the engine rotation speed and the current value of the air flow rate. Further, an area A21 inside the threshold value (line L21) of the Mahalanobis distance can be regarded as being closer to the unit space than an area A22 outside the threshold value of the Mahalanobis distance.

In a case where the Mahalanobis distance obtained for the current value of the engine rotation speed and the current value of the air flow rate is equal to or less than the threshold value, the surge determination unit 392 determines that no surge has occurred. On the other hand, in a case where the Mahalanobis distance is larger than the threshold value, the surge determination unit 392 determines that a surge has occurred.

That is, in a case where the current value of the engine rotation speed and the current value of the air flow rate are included in the area A21 relatively close to the unit space, the surge determination unit 392 determines that no surge has occurred. On the other hand, if the current value of the engine rotation speed and the current value of the air flow rate are included in the area A22 relatively far from the unit space, the surge determination unit 392 determines that a surge occurs.

As the determination condition set by the determination condition setting unit 391 is described, the surge determination unit 392 may determine whether or not there is a surge on the basis of other variables, in addition to the engine rotation speed and the air flow rate. Further, the determination performed by the surge determination unit 392 is not limited to the determination based on the Mahalanobis distance. For example, the surge determination unit 392 may determine whether or not there is a surge on the basis of multiple regression analysis.

Next, an operation of the surge determination device 300 will be described with reference to FIG. 4.

Figure 4:
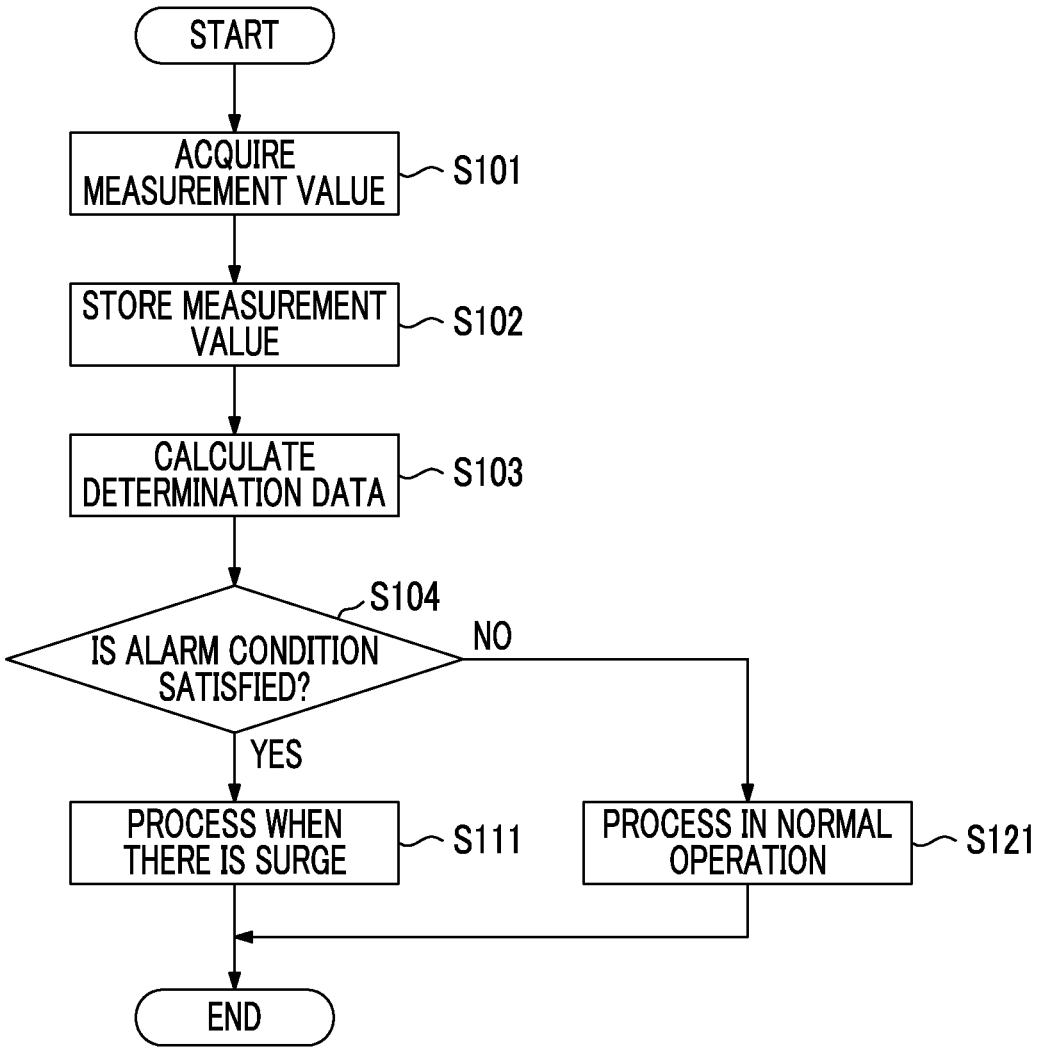
FIG. 4 is a flowchart illustrating an example of a processing procedure in which a surge determination device determines whether or not there is a surge of a compressor in the embodiment.

FIG. 4 is a flowchart illustrating an example of a processing procedure in which the surge determination device 300 determines whether or not there is a surge of the compressor 130. The surge determination device 300 repeats a process of FIG. 4, for example, regularly such as in a certain period.

In the process of FIG. 4, the data acquisition unit 310 acquires the current value of the air flow rate measured by the air flow meter 210 and the current value of the engine rotation speed measured by the rotation speed meter 220 (step S101).

Then, the control unit 390 stores the measurement value (the current value of the air flow rate and the current value of the engine rotation speed) obtained in step S101 in the storage unit 380 (step S102). That is, the control unit 390 writes the measurement value obtained in step S101 to a storage area of the storage unit 380. In this case, the control unit 390 adds new data without erasing the data already stored in the storage unit 380 to store time-series data of the measurement value in the storage unit 380.

The data stored in the storage unit 380 in step S102 is used for the determination condition setting unit 391 to set the determination condition at the time of the next regular inspection.

Further, the surge determination unit 392 calculates determination data on the basis of the measurement value obtained in step S101 (step S103). Specifically, the surge determination unit 392 applies the measurement value obtained in step S101 to the equation set by the determination condition setting unit 391 to obtain the Mahalanobis distance.

Then, the surge determination unit 392 determines whether or not a value of the determination data obtained in step S103 satisfies an alarm condition (step S104). The alarm condition described herein is a condition for determining that there is a surge and outputting an alarm.

Specifically, the surge determination unit 392 determines whether or not the Mahalanobis distance obtained in step S103 is larger than the threshold value prestored in the storage unit 380. A case where the Mahalanobis distance is larger than the threshold value corresponds to an example of satisfaction of the alarm condition, and a case where the Mahalanobis distance is equal to or less than the threshold value corresponds to an example of unsatisfaction of the alarm condition.

In a case where it is determined in step S104 that the determination data satisfies the alarm condition (step S104: YES), the control unit 390 performs a process in a case where there is a surge (step S111). For example, the control unit 390 outputs an alarm signal indicating that there is a surge to display an alarm indicating that there is a surge on a panel (dashboard) at a driver's seat. Alternatively, in addition to or in place of the alarm display, the control unit 390 may perform control for eliminating the surge or control for reducing the surge, such as disconnecting the turbocharger 100 from an air flow path of the engine 200 and stopping the turbocharger 100.

After step S111, the process of FIG. 4 ends.

On the other hand, in a case where it is determined in step S104 that the determination data does not satisfy the alarm condition (step S104: NO), the control unit 390 performs a process in a normal operation (step S121). The control unit 390 may not perform a separate process in step S121. Alternatively, the control unit 390 may store a determination result indicating normality in the storage unit 380.

After step S121, the process of FIG. 4 ends.

As described above, the surge determination unit 392 determines whether or not there is a surge of the compressor 130 on the basis of the engine rotation speed and the air flow rate.

A response of the air flow rate is faster than that of a temperature, and in this regard, the surge determination device 300 can rapidly detect a surge of the compressor 130.

Further, since the sensor provided as a standard in a vehicle or the like is used as the air flow meter 210 or the rotation speed meter 220, it is possible to reduce an installation cost of the surge determination device 300.

Further, since a response speed of a temperature is generally slow, surge detection is likely to take time if a temperature sensor is used for a surge determination. On the other hand, in the engine system 1, since the measurement values of the engine rotation speed and the air flow rate of which a response is fast are used, it is possible to avoid delay of surge detection based on temperature.

The surge determination device 300 may be used for backup for a surge detection system based on a temperature or the like. Even in a case where the surge detection system does not function due to failure of a temperature sensor, or the like, the surge determination device 300 can detect the surge.

Further, the determination condition setting unit 391 sets a determination condition for a determination as to whether or not there is a surge on the basis of the engine rotation speed and the air flow rate when it is determined that no surge has occurred in the compressor 130. For example, the determination condition setting unit 391 acquires an equation for calculation of a Mahalanobis distance on the basis of data belonging to the unit space.

Thus, since the determination condition setting unit 391 sets the determination condition on the basis of the data in a normal operation, a process of acquiring the data in an abnormal operation, such as forcibly causing the turbocharger 100 or the engine 200 to operate abnormally, is unnecessary. In this regard, a load of a process that is performed as a pre-process of the surge determination by the engine system 1 is small. Further, if the turbocharger 100 or the engine 200 is operated abnormally, a load is likely to be applied to the turbocharger 100 or the engine 200. However, such a load can be avoided since the determination condition setting unit 391 sets the determination condition on the basis of the data in a normal operation.

Further, since the determination condition is set by the determination condition setting unit 391 on the basis of the data in a normal operation, the data may be acquired at the time of a normal operation of the turbocharger 100 or the engine 200, and the data can be easily stored. Accordingly, it is not necessary for data of another turbocharger or another engine to be used. Here, even in a case where the turbocharger or the engine is of the same type, characteristics are greatly different for each device. On the other hand, since the determination condition setting unit 391 sets the determination condition without using the data of another turbocharger or another engine, the surge determination unit 392 can accurately determine whether or not there is a surge.

Further, the determination condition setting unit 391 sets the determination condition based on the Mahalanobis distance. Accordingly, the process of the determination condition setting unit 391 and the process of the surge determination unit 392 can be flexible. For example, the determination condition setting unit 391 can set the determination condition based not only on the engine rotation speed and the air flow rate, but also on other variables.

The surge determination unit 392 may determine whether or not there is a surge on the basis of a determination condition including a time element. For example, in a case where a state in which the Mahalanobis distance is larger than the threshold value continues for a predetermined time or more, the surge determination unit 392 may determine that the surge of the compressor 130 occurs.

As a result, for example, in a case where the air flow rate instantaneously decreases or in a case where noise is contained in a signal from the air flow meter 210 or a signal from the rotation speed meter 220, it is possible to reduce a possibility of the surge determination unit 392 erroneously determining that there is a surge.

Alternatively, in a case where a state in which the Mahalanobis distance is larger than the threshold value appears a predetermined number of times or more in a predetermined time, the surge determination unit 392 may determine that the surge of the compressor 130 occurs.

As a result, for example, in a case where the air flow rate instantaneously decreases or in a case where noise is contained in a signal from the air flow meter 210 or a signal from the rotation speed meter 220, it is possible to reduce a possibility of the surge determination unit 392 erroneously determining that there is a surge.

Further, a process of each unit may be performed by recording a program for realizing all or some functions of the control unit 390 on a computer-readable recording medium, loading the program recorded on the recording medium into a computer system, and executing the program. The "computer system" described herein includes an OS or hardware such as a peripheral device.

Further, the "computer system" includes a homepage providing environment (or display environment) if a WWW system is being used.

The "computer-readable recording medium" refers to a portable medium such as a flexible disk, a magneto-optical disc, a ROM, or a CD-ROM, or a storage device such as a hard disk embedded in the computer system. Further, the "computer-readable recording medium" also includes a recording medium that dynamically holds a program for a short period of time, such as a communication line when the program is transmitted over a network such as the Internet or a communication line such as a telephone line or a recording medium that holds a program for a certain period of time, such as a volatile memory inside a computer system including a server and a client in such a case. Further, the program may be a program for realizing some of the above-described functions or may be a program capable of realizing the above-described functions in combination with a program previously stored in the computer system.

The embodiments of the present invention have been described above in detail with reference to the accompanying drawings, but a specific configuration is not limited to the embodiments, and design changes without departing from the scope of the invention are also included.

INDUSTRIAL APPLICABILITY

The present invention relates to the surge determination device including the surge determination unit that determines whether or not there is a surge of the compressor that outputs compressed air to the engine on the basis of the engine rotation speed and the air flow rate.

According to the present invention, it is possible to determine whether or not there is a surge without the need to provide a temperature sensor.

REFERENCE SIGNS LIST

1 engine system
200 engine
210 air flow meter
220 rotation speed meter
100 turbocharger
110 turbine
120 shaft
130 compressor
300 surge determination device
310 data acquisition unit
380 storage unit
390 control unit
391 determination condition setting unit
392 surge determination unit

The invention claimed is:

1. A surge determination device that determines a surge of a compressor that outputs compressed air to an engine, the surge determination device comprising:

an airflow meter that detects an intake flow rate of air supplied to the engine;

a rotation speed meter that detects a rotation speed of the engine;

a processor and a storage unit that stores a program that causes the processor to:

obtain the rotation speed of the engine;

obtain the intake flow rate;

calculate a determination condition for determining whether there is the surge based on both the rotation speed and the intake flow rate;

apply a current rotation speed and a current intake flow rate to the calculated determination condition; and determine whether there is the surge by comparing a result of the applying step with a predetermined threshold value, wherein the compressor is disconnected from an intake air flow path of the engine that supplies intake air to the engine when the surge of the compressor is detected in the surge determining step.

2. The surge determination device according to claim 1, wherein, the determination condition is calculated by:

storing the obtained rotation speed over time;

storing the obtained intake flow rate over time;

calculating an average of the stored rotation speed;

calculating an average of the stored intake flow rate; and setting a Mahalanobis distance based on the calculated average rotation speed and the calculated average intake flow rate.

3. The surge determination device according to claim 1, wherein the determining step determines that a surge occurs in a case where the applied result is greater than the predetermined threshold value for a predetermined time or more.

4. The surge determination device according to claim 1, wherein the determining step determines that a surge occurs in a case where the applied result is greater than the predetermined threshold value appears a predetermined times or more for a predetermined time.

5. A surge determination method for a surge determination device that determines a surge of a compressor that outputs compressed air to an engine, the method comprising:

obtaining an intake flow rate of or air supplied to the engine;

obtaining a rotation speed of the engine;

calculating a determination condition for determining whether there is the surge based on the rotation speed and the intake flow rate;

applying a current rotation speed and a current intake flow rate to the calculated determination condition; and determining whether there is the surge by comparing a result of the applying step with a predetermined threshold value, wherein the compressor from the engine is disconnected from an intake air flow path of the engine that supplies intake air to the engine when the surge of the compressor is detected in the surge determining step.

6. A program for causing a processor to execute a surge determination of determining whether or not there is a surge of a compressor that outputs compressed air to an engine, the program causes the processor to:

obtain an intake flow rate of or air supplied to the engine;

obtain a rotation speed of the engine;

calculate a determination condition for determining whether there is the surge based on the rotation speed and the intake flow rate;

apply a current rotation speed and a current intake flow rate to the calculated determination condition; and determine whether there is the surge by comparing a result of the applying step with a predetermined threshold value, wherein the compressor from the engine is disconnected from an air flow path of the engine that supplies intake air to the engine when the surge of the compressor is detected in the surge determining step.

7. The surge determination device according to claim 2, wherein, the determination condition is calculated further by:

calculating a variance of the rotation speed;

calculating a variance of the intake flow rate; and setting a Mahalanobis distance based on the calculated average rotation speed, the calculated average intake flow rate, the calculated variance of the rotation speed, the calculated variance of the intake flow rate, and a covariance between the obtained engine rotation speed and the obtained intake flow rate.

* * * * *